US010893373B2

(12) United States Patent
McGrath

(10) Patent No.: US 10,893,373 B2
(45) Date of Patent: Jan. 12, 2021

(54) PROCESSING OF A MULTI-CHANNEL SPATIAL AUDIO FORMAT INPUT SIGNAL

(71) Applicant: Dolby Laboratories Licensing Corporation, San Francisco, CA (US)

(72) Inventor: David S. McGrath, Rose Bay (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 16/611,843

(22) PCT Filed: May 2, 2018

(86) PCT No.: PCT/US2018/030680
§ 371 (c)(1),
(2) Date: Nov. 7, 2019

(87) PCT Pub. No.: WO2018/208560
PCT Pub. Date: Nov. 15, 2018

(65) Prior Publication Data

US 2020/0169824 A1 May 28, 2020

Related U.S. Application Data

(60) Provisional application No. 62/598,068, filed on Dec. 13, 2017, provisional application No. 62/503,657, filed on May 9, 2017.

(30) Foreign Application Priority Data

Jul. 3, 2017 (EP) ..... 17179315

(51) Int. Cl.
*H04S 3/02* (2006.01)
*H04R 5/00* (2006.01)
(Continued)

(52) U.S. Cl.
CPC ..... *H04S 7/303* (2013.01); *G10L 19/008* (2013.01); *H04S 3/008* (2013.01); *H04S 3/02* (2013.01);
(Continued)

(58) Field of Classification Search
CPC . H04R 2430/23; H04R 2430/20; H04R 5/027
(Continued)

(56) References Cited

U.S. PATENT DOCUMENTS 8,705,750 B2 4/2014 Berge
8,891,797 B2 11/2014 Thiergart
(Continued)

FOREIGN PATENT DOCUMENTS

EP 2249334 A1 11/2010
EP 2469741 A1 6/2012
(Continued)

OTHER PUBLICATIONS

"Dolby Atmos Next-Generation Audio for Cinema" Apr. 1, 2012.
Nils, Peters et al., Scene-based Audio Implemented with Higher Order Ambisonics (HOA), IEEE Xplore, SMPTE 2015.

*Primary Examiner* — George C Monikang

(57) ABSTRACT

Apparatus, computer readable media and methods for processing a multi-channel, spatial audio format input signal. For example, one such method comprises determining object location metadata based on the received spatial audio format input signal; and extracting object audio signals based on the received spatial audio format input signal, wherein the extracting object audio signals based on the received spatial audio format input signal includes determining object audio signals and residual audio signals.

18 Claims, 8 Drawing Sheets

(51) Int. Cl.

| | |
|---|---|
| ***H04S 5/02*** | (2006.01) |
| ***H04S 7/00*** | (2006.01) |
| ***G10L 19/008*** | (2013.01) |
| ***H04S 3/00*** | (2006.01) |

(52) U.S. Cl.
CPC ..... *H04S 2400/11* (2013.01); *H04S 2420/03* (2013.01); *H04S 2420/07* (2013.01); *H04S 2420/11* (2013.01)

(58) Field of Classification Search
USPC ..... 381/17–19, 22, 23, 303
See application file for complete search history.

(56) References Cited

U.S. PATENT DOCUMENTS

| | | | | |
|---|---|---|---|---|
| 9,445,199 | B2 | 9/2016 | Kruger | |
| 9,589,571 | B2 | 3/2017 | Wuebbolt | |
| 9,622,008 | B2 | 4/2017 | Krueger | |
| 2010/0329466 | A1 | 12/2010 | Berge | |
| 2011/0137662 | A1* | 6/2011 | McGrath | G10L 19/173 704/500 |
| 2011/0178798 | A1* | 7/2011 | Flaks | H04S 3/008 704/226 |
| 2014/0023197 | A1* | 1/2014 | Xiang | G10L 19/008 381/17 |
| 2014/0372107 | A1 | 12/2014 | Vilermo | |
| 2015/0055797 | A1* | 2/2015 | Nguyen | H04R 3/005 381/92 |
| 2015/0162012 | A1 | 6/2015 | Kastner | |
| 2015/0340044 | A1 | 11/2015 | Kim | |
| 2016/0007132 | A1 | 1/2016 | Peters | |
| 2016/0267914 | A1 | 9/2016 | Hu | |
| 2017/0011750 | A1 | 1/2017 | Liu | |
| 2017/0105085 | A1 | 4/2017 | Kim | |

FOREIGN PATENT DOCUMENTS

| | | |
|---|---|---|
| WO | 2015175933 | 11/2015 |
| WO | 2016001352 A1 | 1/2016 |
| WO | 2016001356 A1 | 1/2016 |
| WO | 2016001357 A1 | 1/2016 |
| WO | 2016133785 A1 | 8/2016 |
| WO | 2017055485 A1 | 4/2017 |

* cited by examiner

PROCESSING OF A MULTI-CHANNEL SPATIAL AUDIO FORMAT INPUT SIGNAL

CROSS-REFERENCE TO RELATED APPLICATIONS

This application claims the benefit of priority from U.S. Provisional Patent Application No. 62/598,068 filed on Dec. 13, 2017, European Patent Application No. 17179315.1 filed Jul. 3, 2017, and U.S. Provisional Patent Application No. 62/503,657 filed May 9, 2017, each of which is incorporated herein by reference.

TECHNICAL FIELD

The present disclosure relates to immersive audio format conversion, including conversion of a spatial audio format (for example, Ambisonics, Higher Order Ambisonics, or B-format) to an object-based format (for example Dolby's Atmos format).

SUMMARY

The present document addresses the technical problem of converting a spatial audio format (for example, Ambisonics, Higher Order Ambisonics, or B-format) to an object-based format (e.g., Dolby's Atmos format).

In this regard, the term "spatial audio format", as used throughout the specification and claims, particularly relates to audio formats providing loudspeaker-independent signals which represent directional characteristics of a sound field recorded at one or more locations. Moreover, the term "object-based format", as used throughout the specification and claims, particularly relates to audio formats providing loudspeaker-independent signals which represent sound sources.

An aspect of the document relates to a method of processing a multi-channel, spatial fauna input audio signal (i.e., an audio signal in a spatial format (spatial audio fauna) which includes multiple channels). The spatial format (spatial audio format) may be Ambisonics, Higher Order Ambisonics (HOA), or B-format, for example. The method may include analyzing the input audio signal to determine a plurality of object locations of audio objects included in the input audio signal. The object locations may be spatial locations, e.g., indicated by 3-vectors in Cartesian or spherical coordinates.

Alternatively, the object locations may be indicated in two dimensions, depending on the application.

The method may further include, for each of a plurality of frequency subbands of the input audio signal, determining, for each object location, a mixing gain for that frequency subband and that object location. To this end, the method may include applying a time-to-frequency transform to the input audio signal and arranging the resulting frequency coefficients into frequency subbands. Alternatively, the method may include applying a filterbank to the input audio signal. The mixing gains may be referred to as object gains.

The method may further include, for each frequency subband, generating, for each object location, a frequency subband output signal based on the input audio signal, the mixing gain for that frequency subband and that object location, and a spatial mapping function of the spatial format. The spatial mapping function may be a spatial decoding function, for example spatial decoding function DS(loc).

The method may yet further include, for each object location, generating an output signal by summing over the frequency subband output signals for that object location. The sum may be a weighted sum. The object locations may be output as object location metadata (e.g., object location metadata indicative of the object locations may be generated and output). The output signals may be referred to as object signals or object channels. The above processing may be performed for each predetermined period of time (e.g., for each time-block, or each transformation window of a time-to-frequency transform).

Typically, known approaches for format conversion from a spatial format to an object-based format apply a broadband approach when extracting audio object signals associated with a set of dominant directions. By contrast, the proposed method applies a subband-based approach for determining the audio object signals. Configured as such, the proposed method can provide clear panning/steering decisions per subband. Thereby, increased discreteness in directions of audio objects can be achieved, and there is less "smearing" in the resulting audio objects. For example, after determining the dominant directions (possibly using a broadband approach or using a subband-based approach), it may turn out that a certain audio object is panned to one dominant direction in a first frequency subband, but is panned to another dominant direction in a second frequency subband. This different panning behavior of the audio object in different subbands would not be captured by known approaches for format conversion, at the cost of decreased discreteness of directivity and increased smearing.

In some examples, the mixing gains for the object locations may be frequency-dependent.

In some examples, the spatial format may define a plurality of channels. Then, the spatial mapping function may be a spatial decoding function of the spatial format for extracting an audio signal at a given location, from the plurality of the channels of the spatial format. At a given location shall mean incident from the given location, for example.

In some examples, a spatial panning function of the spatial format may be a function for mapping a source signal at a source location to the plurality of channels defined by the spatial format. At a source location shall mean incident from the source location, for example. Mapping may be referred to as panning. The spatial decoding function may be defined such that successive application of the spatial panning function and the spatial decoding function yields unity gain for all locations on the unit sphere. The spatial decoding function may be further defined such that the average decoded power is minimized.

In some examples, determining the mixing gain for a given frequency subband and a given object location may be based on the given object location and a covariance matrix of the input audio signal in the given frequency subband.

In some examples, the mixing gain for the given frequency subband and the given object location may depend on a steering function for the input audio signal in the given frequency subband, evaluated at the given object location.

In some examples, the steering function may be based on the covariance matrix of the input audio signal in the given frequency subband.

In some examples, determining the mixing gain for the given frequency subband and the given object location may be further based on a change rate of the given object location over time. The mixing gain may be attenuated in dependence on the change rate of the given object location. For instance, the mixing gain may be attenuated if the change rate is high, and may not be attenuated for a static object location.

In some examples, generating, for each frequency subband and for each object location, the frequency subband output signal may involve applying a gain matrix and a spatial decoding matrix to the input audio signal. The gain matrix and the spatial decoding matrix may be successively applied. The gain matrix may include the determined mixing gains for that frequency subband. For example, the gain matrix may be a diagonal matrix, with the mixing gains as its diagonal elements, appropriately ordered. The spatial decoding matrix may include a plurality of mapping vectors, one for each object location. Each mapping vector may be obtained by evaluating the spatial decoding function at a respective object location. For example, the spatial decoding function may be a vector-valued function (e.g., yielding an $1\times n_s$ row vector if the multi-channel, spatial format input audio signal is defined as a $n_s\times 1$ column vector, $\mathbb{R}^3\rightarrow\mathbb{R}^{n_s}$).

In some examples, the method may further include re-encoding the plurality of output signals into the spatial format to obtain a multi-channel, spatial format audio object signal. The method may yet further include subtracting the audio object signal from the input audio signal to obtain a multi-channel, spatial format residual audio signal. The spatial format residual signal may be output together with the output signals and location metadata, if any.

In some examples, the method may further include applying a downmix to the residual audio signal to obtain a downmixed residual audio signal. The number of channels of the downmixed residual audio signal may be smaller than the number of channels of the input audio signal. The downmixed spatial format residual signal may be output together with the output signals and location metadata, if any.

In some examples, analyzing the input audio signal may involve, for each frequency subband, determining a set of one or more dominant directions of sound arrival. Analyzing the input audio signal may further involve determining a union of the sets of the one or more dominant directions for the plurality of frequency subbands. Analyzing the input audio signal may yet further involve applying a clustering algorithm to the union of the sets to determine the plurality of object locations.

In some examples, determining the set of dominant directions of sound arrival may involve at least one of: extracting elements from the covariance matrix of the input audio signal in the frequency subband, and determining local maxima of a projection function of the input audio signal in the frequency subband. The projection function may be based on the covariance matrix of the input audio signal and a spatial panning function of the spatial format.

In some examples, each dominant direction may have an associated weight. Then, the clustering algorithm may perform weighted clustering of the dominant directions. Each weight may be indicative of a confidence value for its dominant direction, for example. The confidence value may indicate a likelihood of whether an audio object is actually located at the object location.

In some examples, the clustering algorithm may be one of a k-means algorithm, a weighted k-means algorithm, an expectation-maximization algorithm, and a weighted mean algorithm.

In some examples, the method may further include generating object location metadata indicative of the object locations. The object location metadata may be output together with the output signals and the (downmixed) spatial format residual signal, if any.

Another aspect of the document relates to an apparatus for processing a multi-channel, spatial format input audio signal. The apparatus may include a processor. The processor may be adapted to analyze the input audio signal to determine a plurality of object locations of audio objects included in the input audio signal. The processor may be further adapted to, for each of a plurality of frequency subbands of the input audio signal, determine, for each object location, a mixing gain for that frequency subband and that object location. The processor may be further adapted to, for each frequency subband, generate, for each object location, a frequency subband output signal based on the input audio signal, the mixing gain for that frequency subband and that object location, and a spatial mapping function of the spatial format. The processor may be yet further adapted to, for each object location, generate an output signal by summing over the frequency subband output signals for that object location. The apparatus may further comprise a memory coupled to the processor. The memory may store respective instructions for execution by the processor.

Another aspect of the document relates to software program. The software program may be adapted for execution on a processor and for performing the method steps outlined in the present document when carried out on the processor.

Another aspect of the document relates to a storage medium. The storage medium may comprise a software program adapted for execution on a processor and for performing the method steps outlined in the present document when carried out on the processor.

Another aspect of the document relates to a computer program product. The computer program may comprise executable instructions for performing the method steps outlined in the present document when executed on a computer.

Another aspect of the present document relates to a method for processing a multi-channel, spatial audio format input signal, the method comprising determining object location metadata based on the received spatial audio format input signal; and extracting object audio signals based on the received spatial audio format input signal. The extracting object audio signals is based on the received spatial audio format input signal includes determining object audio signals and residual audio signals.

Each extracted audio object signal may have a corresponding object location metadata. The object location metadata may be indicative of the direction-of-arrival of an object. The object location metadata may be derived from statistics of the received spatial audio format input signal. The object location metadata may change from time to time. The object audio signals may be determined based on a a linear mixing matrix in each of a number of sub-bands of the received spatial audio format input signal. The residual signal may be a multi-channel residual signal that may be composed of a number of channels that is less than a number of channels of the received spatial audio format input signal.

The extracting object audio signals may be determined by subtracting the contribution of the said object audio signals from the said spatial audio format input signal. The extracting object audio signals may also include determining a linear mixing matrix coefficients that may be used by subsequent processing to create the one or more object audio signals and the residual signal. The matrix coefficients may be different for each frequency band.

Another aspect of the present document relates to an apparatus for processing a multi-channel, spatial audio format input signal, the apparatus comprising a processor for determining object location metadata based on the received spatial audio format input signal; and an extractor for extracting object audio signals based on the received spatial audio format input signal, wherein the extracting object audio signals based on the received spatial audio format input signal includes determining object audio signals and residual audio signals.

It should be noted that the methods and systems including its embodiments as outlined in the present patent application may be used stand-alone or in combination with the other methods and systems disclosed in this document. Furthermore, all aspects of the methods and systems outlined in the present patent application may be arbitrarily combined. In particular, the features of the claims may be combined with one another in an arbitrary manner.

BRIEF DESCRIPTION OF THE DRAWINGS

The invention is explained below in an exemplary manner with reference to the accompanying drawings, wherein.

DETAILED DESCRIPTION

Figure 1:
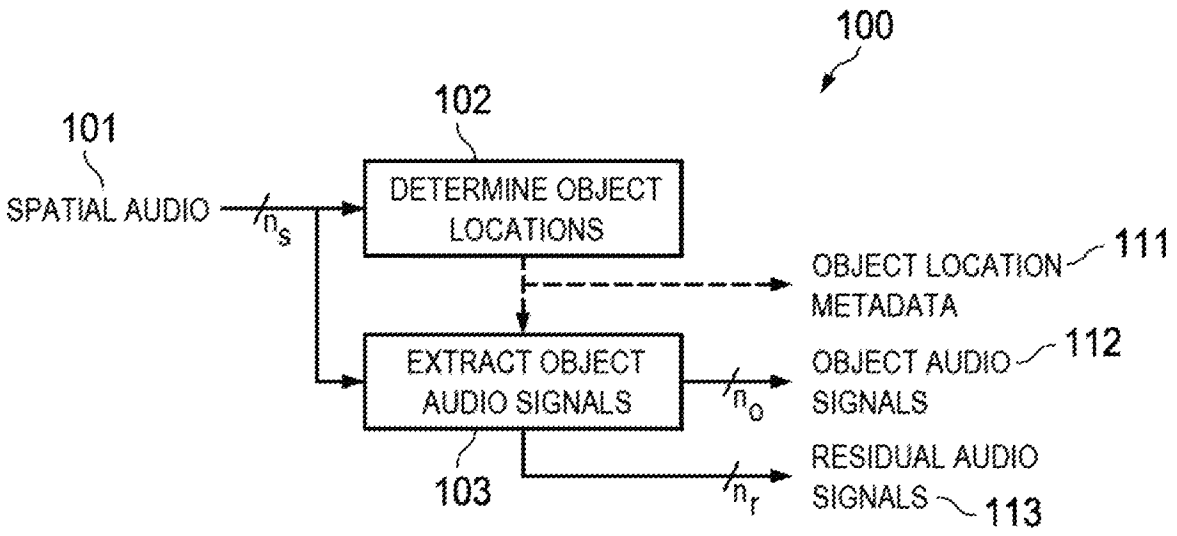
FIG. 1 illustrates an exemplary conceptual block diagram illustrating an aspect of the present invention.

FIG. 1 illustrates an exemplary conceptual block diagram illustrating an exemplary system 100 of the present invention. The system 100 includes a $n_s$-channel Spatial Audio Format 101 that may be an input received by the system 100. The Spatial Audio Format 101 may be a B-format, an Ambisonics format, or an HOA format. The output of the system 100 may include:

- $n_o$ audio output channels, representing $n_o$ audio objects;
- Location data, specifying the time-varying location of the $n_o$ objects;
- A set of $n_r$ residual audio channels, representing the original soundfield with the $n_o$ objects removed.

The system 100 may include a first processing block 102 for determining object locations and a second processing block 103 for extracting object audio signals. Block 102 may be configured to include processing for analyzing the Spatial Audio signal 101 and determining the location of a number ($n_o$) of objects, at regular instances in time (defined by the time-interval, $\tau_m$). That is, the processing may be performed for each predetermined period of time.

For example, the location of object $o(1 \le o \le n_o)$ at time, $t=k\tau_m$, is given by the 3-vector:

$$\vec{v}_o(k)=(x_o(k)y_o(k)z_o(k))^T \quad \text{Equation 1}$$

Depending on the application (e.g., for planar configurations), the location of object $o(1 \le o \le n_o)$ at time, $t=k\tau_m$ may be given by a 2-vector.

Block 102 may output the object location metadata 111 and may provide object location information to block 103 for further processing.

Block 103 may be configured to include processing for processing the Spatial Audio signal (input audio signal) 101, to extract $n_o$ audio signals (output signals, object signals, or object channels) 112 that represent the $n_o$ audio objects (with locations defined by $\vec{v}_o(k)$, where $1 \le o \le n_o$). The $n_r$-channel residual audio signal (spatial format residual audio signal or downmixed spatial format residual audio signal) 113 is also provided as output of this second stage.

Figure 2:
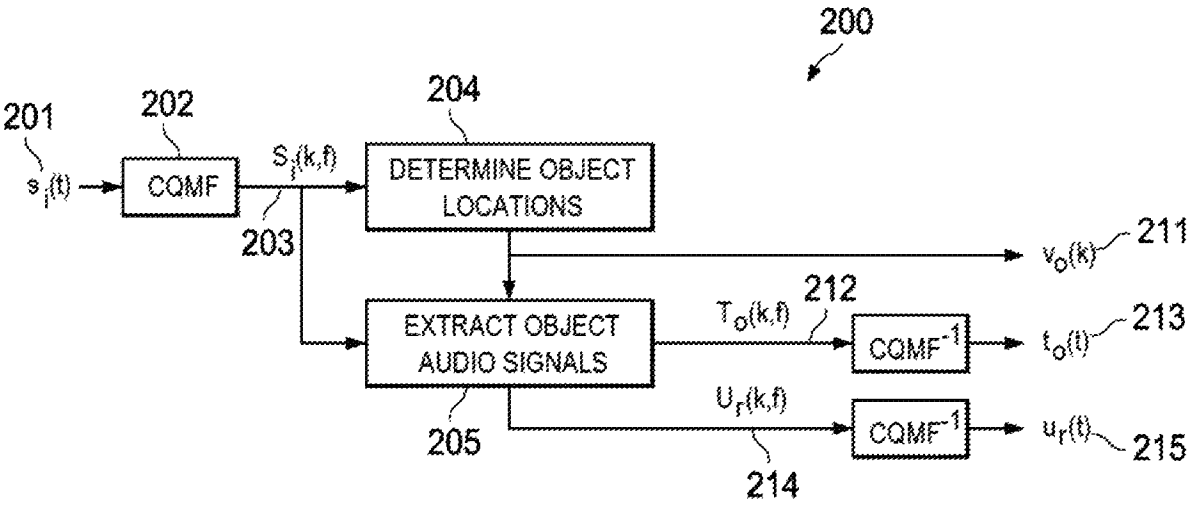
FIG. 2 illustrates an exemplary conceptual block diagram illustrating an aspect of the present invention relating to frequency-domain transforms.

FIG. 2 illustrates an exemplary conceptual block diagram illustrating an aspect of the present invention relating to frequency-domain transforms. In a preferred embodiment, the input and output audio signals are processed in the Frequency Domain (for example, by using CQMF transformed signals). The variables shown in FIG. 2 may be defined as follows:

Indices:
$i \in [1, n_s]$=input channel number (1)
$o \in [1, n_o]$=output object number (2)
$r \in [1, n_r]$=output residual channel number (3)
$k \in \mathbb{Z}$=block number (4)
$f \in [1, n_f]$=frequency bin number (5)
$b \in [1, n_b]$=frequency band number (6)
Time-domain signals:
$s_i(t)$=input signal for channel i (7)
$t_o(t)$=output signal for object o (8)
$u_r(t)$=output residual channel r (9)
Frequency-domain signals:
$S_i(k, f)$=frequency-domain input for channel i (10)
$T_o(k, f)$=frequency-domain output for object o (11)
$U_r(k, f)$=frequency-domain output residual channel r (12)
Object location metadata:
$\vec{v}_o(k)$=location of object o (13)
Time-Frequency grouping:
$band_b(f)$=frequency band window for band b (14)
$win_b(k)$=time window for covariance analysis, for band b (15)
$C_b(k)$=covariance of band b (16)
$C'_b(k)$=normalized covariance of band b (17)
$pwr_b(k)$=total power of the spatial audio signals in band b (18)
$M_b(k)$=matrix for creation of objects for band b (19)
$L_b(k)$=matrix for creation of residual channels for band b (20)

FIG. 2 shows the transformations into and out of the frequency domain. In this Figure, the CQMF and $CQMF^{-1}$ transforms are shown, but other frequency-domain transformations are known in the art, and may be applicable in this situation. Also, a filterbank may be applied to the input audio signal, for example.

In one example, FIG. 2 illustrates a system 200 that includes receiving an input signal (e.g., a multi-channel, spatial format input audio signal, or input audio signal for short). The input signal may include an input signal $s_i(t)$ for each channel i, 201. That is, the input signal may comprise a plurality of channels. The plurality of channels are defined by the spatial format. The input signal for channel i 201 may be transformed into the frequency domain by a CQMF transform 202 that outputs $S_i(k, f)$ (frequency-domain input for channel i) 203. The frequency-domain input for channel i 203 may be provided to Blocks 204 and 205. Block 204 may perform functionality similar to block 102 of FIG. 1 and may output $\vec{v}_o(k)$ (location of object o) 211. The output $\vec{v}_o(k)$ 211 may be a set of outputs, (e.g., for o=1, 2, . . . n). Block 204 may provide object location information to block 205 for further processing. Block 205 may may perform functionality similar to block 103 of FIG. 1. Block 205 may output $T_o(k, f)$ (frequency-domain output for object o) 212 which may be then be transformed by a $CQMF^{-1}$ transform from the frequency domain to the time domain to determine a $t_o(t)$(output signal for object o) 213. Block 205 may further output $U_r(k, f)$ (frequency-domain output residual channel r) 214 which may then be transformed a $CQMF^{-1}$ transform from the frequency domain to the time domain to determine $u_r(t)$ (output residual channel r) 215.

The frequency-domain transformation is carried out at regular time intervals, $\tau_m$, so that the transformed signal, $S_i(k, f)$, at block k, is a Frequency-domain representation of this input signal in a time interval centred around the time, $t=k\tau_m$:

$$S_i(k,f)=\mathrm{CQMF}\{s_i(t-k\tau_m)\} \quad \text{Equation 2}$$

Figure 3:
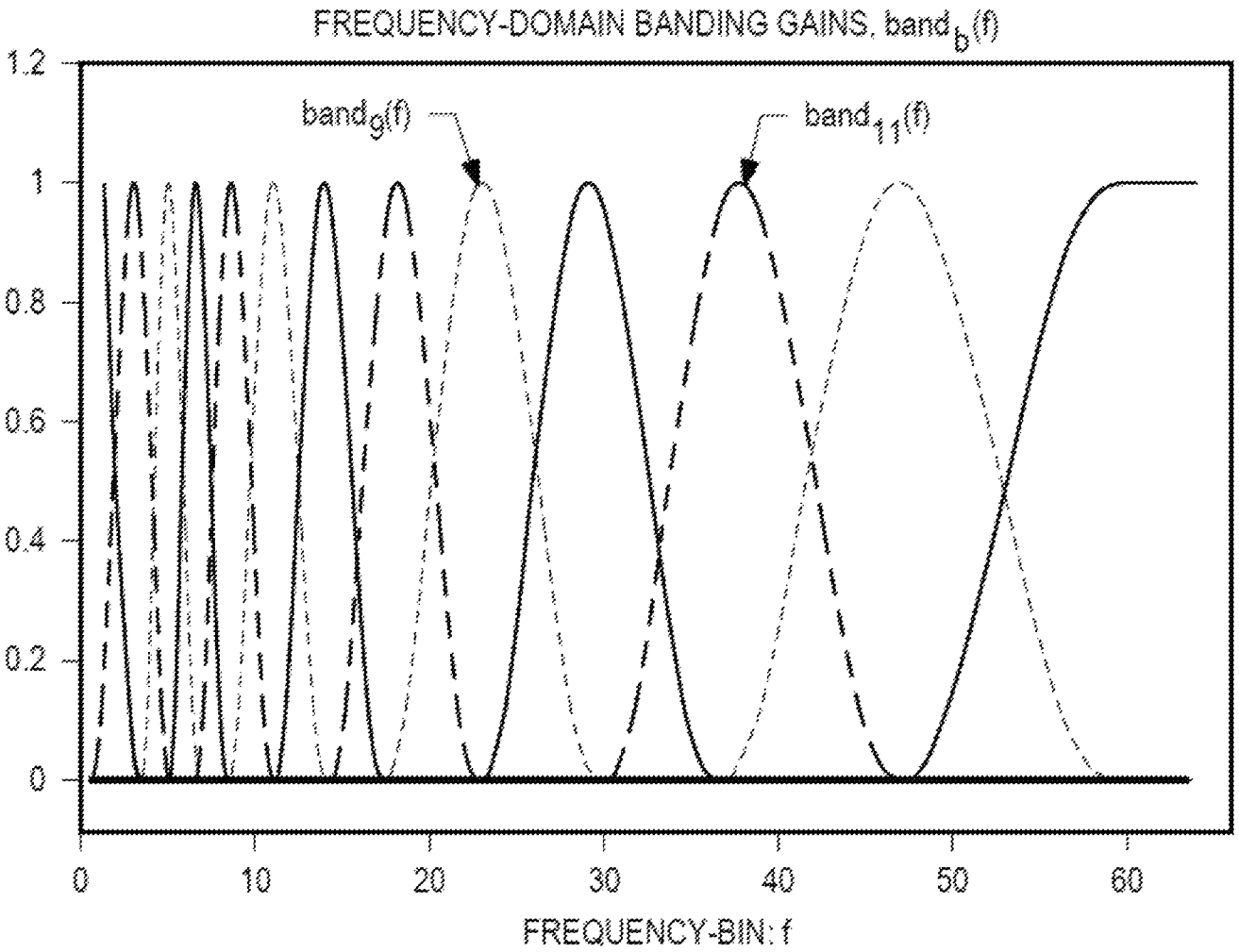
FIG. 3 illustrates an exemplary diagram of Frequency-domain Banding Gains, $band_b(f)$.

In some embodiments, the frequency-domain processing is carried out on a number, $n_b$, of bands. This is achieved by allocating the set of frequency bins ($f\in\{1, 2, \ldots, n_f\}$) to $n_b$ bands. This grouping may be achieved via a set of $n_b$ gain vectors, $band_b(f)$, as shown in FIG. 3. In this example, $n_f=64$ and $n_b=13$.

The Spatial Audio input (input audio signal) may define a plurality of $n_s$ channels. In some embodiments, the Spatial Audio input is analysed by first computing the covariance matrix of the $n_s$ Spatial Audio signals. The covariance matrix may be determined by block 102 of FIG. 1 and block 204 of FIG. 2. In the example described here, the covariance is computed in each frequency band (frequency subband), b, for each time-block, k. Arranging the $n_s$ frequency-domain input signals into a column vector provides:

$$S(k, f)=\begin{pmatrix} S_1(k, f) \\ S_2(k, f) \\ \vdots \\ S_{n_s}(k, f) \end{pmatrix} \quad \text{Equation 3}$$

As a non-limiting example, the covariance (covariance matrix) of the input audio signal may be computed as follows:

$$C_b(k)=\Sigma_{k'}\Sigma_{f=1}^{n_f}\mathrm{win}_b(k-k')\times\mathrm{band}_b(f)\times S(k',f)\times S(k',f)^* \quad \text{Equation 4}$$

where the ■* operator denotes the complex-conjugate transpose.

In general, the covariance, $C_b(k)$, for block k, is a $[n_s\times n_s]$ matrix, computed from the sum (weighted sum) of the outer products: $S(k', f)\times S(k', f)^*$ of the input audio signal in the frequency domain. The weighting functions (if any), $\mathrm{win}_b(k-k')$ and $\mathrm{band}_b(f)$ may be chosen so as to apply greater weights to frequency bins around band b and time-blocks around block k.

Figure 4:
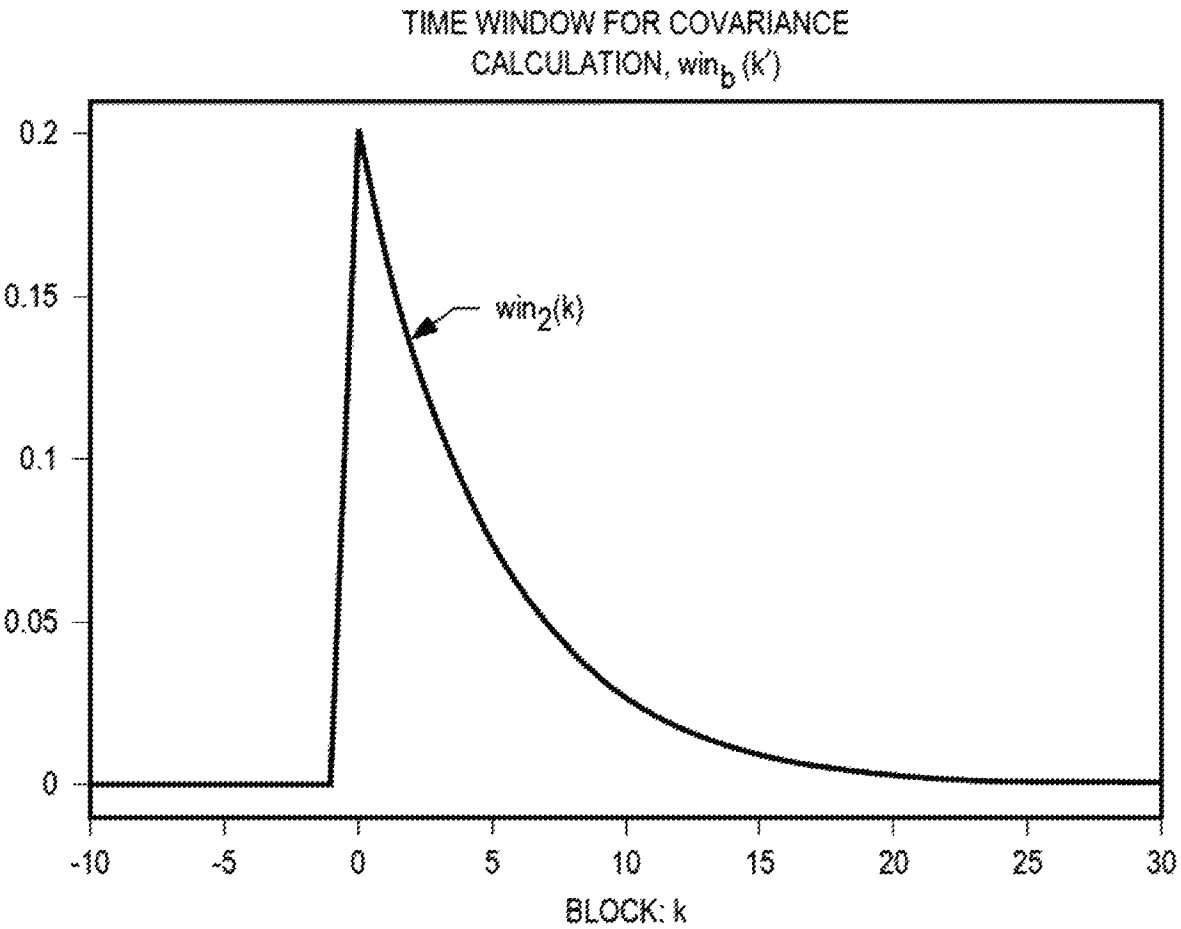
FIG. 4 illustrates an exemplary diagram of a Time-window for covariance calculation, $win_b(k)$.

A typical time-window, $\mathrm{win}_b(k)$, is shown in FIG. 4. In this example, $\mathrm{win}_b(k)=0\forall k<0$, ensuring that the covariance calculation is causal (so, the calculation of the covariance for block k depends only on the frequency-domain input signal at block k or earlier).

The power and normalized covariance may be calculated as follows:

$$pwr_b(k)=tr(C_b(k)) \quad \text{Equation 5}$$

$$C'_b(k)=\frac{1}{pwr_b(k)}\times C_b(k) \quad \text{Equation 6}$$

where tr( ) denotes the trace of the matrix.

Next, the Panning Functions that define the Input Format and the Residual Format will be described.

The Spatial Audio Input signal is assumed to contain auditory elements (where element c consists of the signal $sig_c(t)$ panned to location $loc_c(t)$) that are combined according to a panning rule:

$$s(t)=\begin{pmatrix} s_1(t) \\ s_2(t) \\ \vdots \\ s_{n_s}(t) \end{pmatrix}=\sum_c sig_c(t)\times PS(loc_c(t)) \quad \text{Equation 7}$$

so that the Spatial Input Format is defined by the panning function, PS: $\mathbb{R}^3\rightarrow\mathbb{R}^{n_s}$, which takes a unit-vector as input, and produces a column vector of length $n_s$ as output.

In general, the spatial format (spatial audio format) defines a plurality of channels (e.g., $n_s$. channels). The panning function (or spatial panning function) is a function for mapping (panning) a source signal at a source location (e.g., incident from the source location) to the plurality of channels defined by the spatial format, as shown in the above example. At this, the panning function (spatial panning function) implements a respective panning rule. Analogous statements apply to the panning function (e.g., panning function PR) of the Residual Output signal described below.

Similarly, the Residual Output signal is assumed to contain auditory elements that are combined according to a panning rule, wherein the panning function, PR: $\mathbb{R}^3\rightarrow\mathbb{R}^{n_r}$, which takes a unit-vector as input, and produces a column vector of length $n_r$ as outputNote that these panning functions, PS( ) and PR( ), define the characteristics of the Spatial Input Signal and Residual Output Signal respectively, but this does not mean that these signals are necessarily constructed according to the method of Equation 7. In some embodiments, the number of channels $n_r$ of the Residual Output signal and the number of channels $n_s$ of the Spatial Input Signal may be equal $n_r=n_s$.

Next, the Input Decoding Function will be described.

Given the Spatial Input Format panning function (e.g., PS: $\mathbb{R}^3\rightarrow\mathbb{R}^{n_s}$), it is also useful to derive a Spatial Input Format decoding function (spatial decoding function), DS: $\mathbb{R}^3\rightarrow\mathbb{R}^{n_s}$, which takes a unit vector as input, and returns a row-vector, of length $n_s$, as output. The function DS(loc) should be defined so as to provide a row-vector suitable for extracting a single audio signal from the multi-channel Spatial Input Signal, corresponding with the audio components around the direction specified by loc.

Generally, the panner/decoder combination may be configured to provide unity-gain:

$$DS(\mathrm{loc})\times PS(\mathrm{loc})=1\ \forall \mathrm{loc}\in S^2(\text{the unit-sphere}) \quad \text{Equation 8}$$

Moreover, the average decoded power (integrated over the unit-sphere) may be minimised:

$$AveragePwr=\frac{1}{4\pi}\int\int_{\vec{v}\in S^2}\left|DS(loc)\times PS(\vec{v})\right|^2 d\vec{v} \quad \text{Equation 9}$$

Assuming, for example, that the Spatial Input Signal contains audio components that are panned according to the $2^{nd}$-order Ambisonics panning rules, as per the panning function shown in Equation 10:

$$PS((x\ y\ z)) = \begin{pmatrix} 1 \\ y \\ z \\ x \\ \sqrt{3}\,xy \\ \sqrt{3}\,yz \\ \frac{1}{2}(2z^2 - x^2 - y^2) \\ \sqrt{3}\,xz \\ \frac{\sqrt{3}}{2}(x^2 - y^2) \end{pmatrix} \quad \text{Equation 10}$$

The optimal decoding function, DS( ) may be determined as follows:

$$DS((x\ y\ z)) = \begin{pmatrix} \frac{1}{9} \\ \frac{3}{9}y \\ \frac{3}{9}z \\ \frac{3}{9}x \\ \frac{5}{9}\sqrt{3}\,xy \\ \frac{5}{9}\sqrt{3}\,yz \\ \frac{5}{9}\frac{1}{2}(2z^2 - x^2 - y^2) \\ \frac{5}{9}\sqrt{3}\,xz \\ \frac{5}{9}\frac{\sqrt{3}}{2}(x^2 - y^2) \end{pmatrix}^T \quad \text{Equation 11}$$

The decoding function DS is an example of a spatial decoding function of the spatial format in the context of the present disclosure. In general, the spatial decoding function of the spatial format is a function for extracting an audio signal at a given location loc (e.g., incident from the given location), from the plurality of channels defined by the spatial format. The spatial decoding function may be defined (e.g., determined, calculated) such that successive application of the spatial panning function (e.g., PS) and the spatial decoding function (e.g., DS) yields unity gain for all locations on the unit sphere. The spatial decoding function may be further defined (e.g., determined, calculated) such that the average decoded power is minimized.

next, the steering function will be described.

The Spatial Audio Input signal is assumed to be composed of multiple audio components with respective incident directions of arrival, and hence it is desirable to have a method for estimating the proportion of audio signal that appears in a particular direction, by inspection of the Covariance Matrix. The steering function Steer defined below can provide such an estimate.

Some complex Spatial Input Signals will contain a large number of audio components, and the finite spatial resolution of the Spatial Input Format panning function will mean that there may be some fraction of the total Audio Input power that is considered to be "diffuse" (meaning that this fraction of the signal is considered to be spread uniformly in all directions).

Hence, for any given direction of arrival $\vec{v}$, it is desirable to be able to make an estimation of the amount of the Spatial Audio Input signal that is present in the region around the vector $\vec{v}$, excluding the estimated diffuse amount.

A function (the steering function), Steer(C, $\vec{v}$), may be defined such that the function will take on the value 1.0 whenever the Input Spatial Signal is composed entirely of audio components at location $\vec{v}$, and will take on the value 0.0 when the input Spatial Signal appears to contain no bias towards the direction $\vec{v}$. In general, the steering function is based on (e.g., depends) on the covariance matrix C of the input audio signal. Also, the steering function may be normalized to numerical ranges different from the range [0.0,1.0].

Now it is common to estimate the fraction of the power in a specific direction, $\vec{v}$, in soundfield with normalized covariance C, by using the projection function:

$$\text{proj}(C, \vec{v}) = DS(\vec{v}) \times C \times DS(\vec{v})^T \quad \text{Equation 12}$$

This projection function will take on a larger value whenever the normalized covariance matrix corresponds to an input signal with large signal components in the direction near $\vec{v}$. Likewise, this projection function will take on a smaller value whenever the normalized covariance matrix corresponds to an input signal with no dominant audio components in the direction near $\vec{v}$.

Hence, this projection function may be used to estimate the proportion of the input signal that is biased towards direction $\vec{v}$, by forming a monotonic mapping from the projection function to form the steeling function, Steer(C, $\vec{v}$).

In order to determine this monotonic mapping, first it should be estimated the expected value of the function, proj(C, $\vec{v}$), for the two hypothetical use cases: (1) when the input signal contains a diffuse soundfield, and (2) when the input signal contains a single sound component, in the direction of $\vec{v}$. The following explanation will lead to the definition of the Steer (C, $\vec{v}$) function as described in connection with Equations 20 and 21, based on the DiffusePower and SteerPower, as defined in Equations 16 and 19 below.

Given any input panning function (e.g., input panning function, PS( )), it is possible to determine the average covariance (representing the covariance of a diffuse soundfield):

$$DiffC = \frac{1}{4\pi}\int\int_{\vec{v}\in S^2} PS(\vec{v}) \times PS(\vec{v})\,d\vec{v} \quad \text{Equation 13}$$

The normalized covariance for a diffuse soundfield may be computed as follows:

$$DiffC' = \frac{1}{tr(DiffC)} \times DiffC \quad \text{Equation 14}$$

Now it is common to estimate the fraction of the power in a specific direction, $\vec{v}$, in soundfield with normalized covariance C, by using the projection function:

$$\text{proj}(C,\vec{v})=DS(\vec{v})\times C\times DS(\vec{v})^T \quad \text{Equation 15}$$

When the projection is applied to a diffuse soundfield, the diffuse power in the vicinity of the direction, $\vec{v}$ may be determined as follows:

$$\text{DiffusePower}(\vec{v})=\text{proj}(\text{DiffC}',\vec{v}) \quad \text{Equation 16}$$

Typically, DiffusePower($\vec{v}$) will be a real constant (e.g., DiffusePower($\vec{v}$) is independent of the direction, $\vec{v}$), and hence it may be precomputed, being derived only from the definition of the soundfield input panning function and decode function, PS( ) and DS( ) (as examples of the spatial panning function and the spatial decoding function).

Assuming that a spatial input signal is composed of a single audio component that is located at direction $\vec{v}$, then the resulting covariance matrix will be:

$$\text{SingleC}(\vec{v})=PS(\vec{v})\times PS(\vec{v}) \quad \text{Equation 17}$$

and the normalized covariance will be:

$$SingleC'(\vec{v})=\frac{1}{tr(SingleC(\vec{v}))}\times SingleC(\vec{v}) \quad \text{Equation 18}$$

and hence, the proj( ) function can be applied to determine the SteerPower:

$$\text{SteerPower}(\vec{v})=\text{proj}(\text{Single}C'(\vec{v}),\vec{v}) \quad \text{Equation 19}$$

Typically, SteerPower($\vec{v}$) will be a real constant, and hence it may be precomputed, being derived only from the definition of the soundfield input panning function and decode function, PS( ) and DS( ) (as examples of the spatial panning function and the spatial decoding function).

Forming an estimate of the degree to which the Input Spatial Signal contains a dominant signal from the direction $\vec{v}$, by computing the scaled-projection function, $\psi(C, \vec{v})$, and thence the steering function, Steer(C, $\vec{v}$):

$$\psi(C,\vec{v})=\frac{proj(C',\vec{v})-DiffusePower(\vec{v})}{SteerPower(\vec{v})-DiffusePower(\vec{v})} \quad \text{Equation 20}$$

$$\text{Steer}(C,\vec{v})=\begin{cases}0 & \text{when}\,\psi(C,\vec{v})\le 0\\ 1 & \text{when}\,\psi(C,\vec{v})\ge 1\\ \psi(C,\vec{v}) & \text{otherwise}\end{cases} \quad \text{Equation 21}$$

Generally speaking, the steering function, Steer(C, $\vec{v}$), will take on the value 1.0 whenever the Input Spatial Signal is composed entirely of audio components at location $\vec{v}$, and it will take on the value 0.0 when the Input Spatial Signal appears to contain no bias towards the direction $\vec{v}$. As noted above, the steering function may be normalized to numerical ranges different from the range [0.0,1.0].

In some embodiments, when the Spatial Input Format is a first order Ambisonics format, defined by the panning function:

$$PS((x\ \ y\ \ z))=\left(\frac{1}{\sqrt{2}}\ \ x\ \ y\ \ z\right)^T \quad \text{Equation 22}$$

and a suitable decoding function is:

$$DS((x\ \ y\ \ z))=\left(\frac{1}{2\sqrt{2}}\ \ \frac{3}{4}x\ \ \frac{3}{4}y\ \ \frac{3}{4}z\right) \quad \text{Equation. 23}$$

then the Steer( ) function may be defined as:

$$\text{Steer}(C,\vec{v})=\begin{cases}0 & when\,proj(C,\vec{v})\le\frac{1}{4}\\ \frac{4}{3}proj(C,\vec{v})-\frac{1}{3} & when\,proj(C,\vec{v})>\frac{1}{4}\end{cases} \quad \text{Equation 24}$$

Next, the Residual Format will be described.

In some embodiments, the Residual Output signal may be defined in terms of the same spatial format as the Spatial Input Format (so that the panning functions are the same: PS($\vec{v}$)=PR($\vec{v}$)). The Residual Output signal may be determined by block 103 of FIG. 1 and block 205 of FIG. 2. In this case the number of residual channels will be equal to the number of input channels: $n_r=n_s$. Furthermore, in this case, a residual downmix matrix: $R=I_{n_s}$(the $[n_s\times n_s]$ identity matrix) may be defined.

In some embodiments, the Residual Output signal will be composed of a smaller number of channels than the Spatial Input signal: $n_r<n_s$. In this case, the panning function that defines the residual format will be different to the spatial input panning function. In addition, it is desirable to form a $[n_r\times n_s]$ mixdown matrix, R, suitable for converting a $n_s$-channel Spatial Input signal to a $n_r$-channel residual output channel.

Preferably, R may be chosen to provide a linear transformation from PS( ) to PR( ) (as examples of the spatial panning function of the spatial format and the residual format):

$$PR(\vec{v})=R\times PS(\vec{v})\forall\vec{v} \quad \text{Equation 25}$$

An example of a matrix, R, defined as per Equation 25, is the residual downmix matrix that would be applied if the Spatial Input Format is $3^{rd}$-order Ambisonics and the Residual Format is $1^{st}$-order Ambisonics:

$$R=\begin{pmatrix}1&0&0&0&0&0&0&0&0&0&0&0&0&0&0&0\\0&1&0&0&0&0&0&0&0&0&0&0&0&0&0&0\\0&0&1&0&0&0&0&0&0&0&0&0&0&0&0&0\\0&0&0&1&0&0&0&0&0&0&0&0&0&0&0&0\end{pmatrix} \quad \text{Equation 26}$$

Alternatively, R may be chosen to provide a "least-error" mapping. For example, given a set, $B=\{\vec{b}_1, \vec{b}_2, \ldots, \vec{b}_{n_b}\}$ of $n_b$ unit vectors that are approximately uniformly spread over the unit-sphere, a pair of matrices may be formed by stacking together $n_b$ column vectors:

$$B_S=(PS(\vec{b}_1)\ PS(\vec{b}_1)\ldots PS(\vec{b}_{n_b})) \quad \text{Equation 27}$$

$$B_R=(PR(\vec{b}_1)\ PR(\vec{b}_1)\ldots PR(\vec{b}_{n_b})) \quad \text{Equation 28}$$

where $B_S$ is a $[n_s \times n_b]$ array of Spatial Input panning vectors, and $B_R$ is a $[n_r \times n_b]$ array of Residual Output panning vectors.

A suitable choice for the residual downmix matrix, R, is given by:

$$R = B_R \times B_S^+ \quad \text{Equation 29}$$

where $B_S^+$ indicates the pseudo-inverse of the $B_S$ matrix.

Next, an example of a method 600 of processing a multi-channel, spatial format input audio signal according to embodiments of the disclosure will be described with reference to FIG. 6. The method may use any of the concepts described above. The processing of method 600 may be performed at each time block k, for example. That is, method 600 may be performed for each predetermined period of time (e.g., for each transformation window of a time-to-frequency transform). The multi-channel, spatial format input audio signal may be an audio signal in a spatial format (spatial audio format) and may comprise multiple channels. The spatial format (spatial audio format) may be, but is not limited to, Ambisonics, HOA, or B-format.

At step S610, the input audio signal is analyzed to determine a plurality of object locations of audio objects included in the input audio signal. For example, locations $\vec{v}_o(k)$, of of $n_o$ objects ($o \in [1, n_o]$) may be determined. This may involve performing a scene analysis of the input audio signal. This step may be performed by either of a subband-based approach and a broadband approach.

At step S620, for each of a plurality of frequency subbands of the input audio signal, and for each object location, a mixing gain is determined for that frequency subband and that object location. Prior to this step, the method may further include a step of applying a time-to-frequency transform to a time-domain input audio signal.

At step S630, for each frequency subband, and for each object location, a frequency subband output signal is generated based on the input audio signal, the mixing gain for that frequency subband and that object location, and a spatial mapping function of the spatial format. The spatial mapping function may be the spatial decoding function (e.g., spatial decoding function PS).

At step S640, for each object location, an output signal is generated by summing over the frequency subband output signals for that object location. Further, the object locations may be output as object location metadata. Thus, this step may further comprise generating object location metadata indicative of the object locations. The object location metadata may be output together with the output signals. The method may further include a step of applying an inverse time-to-frequency transform to the frequency-domain output signals.

Figure 7:
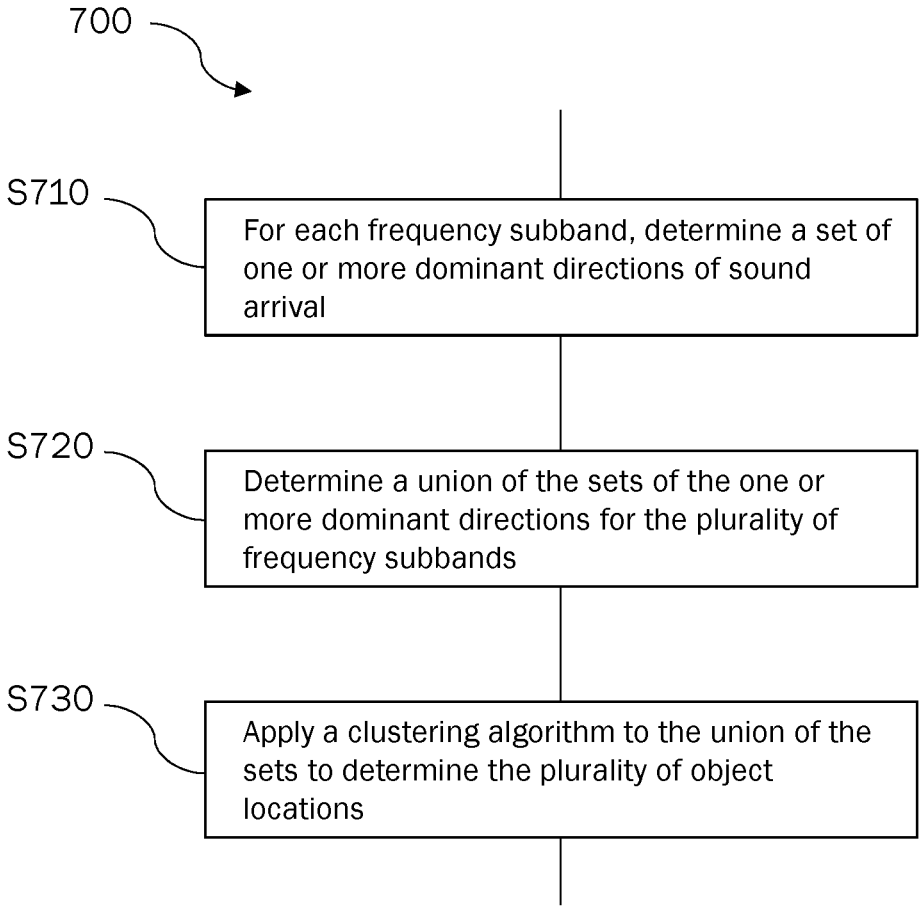
FIG. 7 is flow chart of an example of a method that implements steps of the method of FIG. 6.

Non-limiting examples of processing that may be used for the analyzing of the input audio signal at step S610, i.e., the determination of object locations, will now be described with reference to FIG. 7. This processing may be performed by/at blocks 102 of FIGS. 1 and 204 of FIG. 2, for example. It is a goal of the invention to determine the locations, $\vec{v}_o(k)$, of dominant audio objects within the soundfield (as represented by the Spatial Audio input signal $s_i(t)$ at the time around $t = k\tau_m$). This process may be referred to by the shorthand name DOL, and in a some embodiments, this process is achieved (e.g., at each time-block k) by the steps DOL1, DOL2 and DOL3.

At step S710, for each frequency subband, a set of one or more dominant directions of sound arrival is determined. This may involve performing process DOL1 described below.

DOL1: For each band, b, determine a set, $V_b$, of dominant sound-arrival directions ($\vec{d}_{b,j}$). Each dominant sound-arrival direction may have an associated weighting factor, $w_{b,j}$, indicative of the "confidence" assigned to the respective direction vector:

$$V_b = \{(\vec{d}_{b,1}, w_{b,1}), (\vec{d}_{b,2}, w_{b,2}), \ldots\} \quad \text{Equation 30}$$

The first step (1), DOL1, may be achieved by a number of different methods. Some alternatives are for example:

DOL1(a):

The MUSIC algorithm, which is known in the art (see, for example, Schmidt, R. O, "Multiple Emitter Location and Signal Parameter Estimation," IEEE Trans. Antennas Propagation, Vol. AP-34 (March 1986), pp. 276-280.), may be used to determine a number of dominant directions of arrival, $\vec{d}_{b,1}$, $\vec{d}_{b,2}$, DOL1(b): For some commonly used spatial formats, a single dominant direction of arrival may be determined from the elements of the Covariance matrix. In some embodiments, when the Spatial Input Format is a first order Ambisonics format, defined by the panning function:

$$PS((x \quad y \quad z)) = \left(\frac{1}{\sqrt{2}} \quad x \quad y \quad z\right)^T \quad \text{Equation 31}$$

then an estimate may be made for the dominant direction of arrival in band b, by extracting three elements from the Covariance matrix, and then normalizing to form a unit-vector:

$$\vec{d}_{b,1} = \text{norm}(((C_b(k))_{2,1} (C_b(k))_{3,1} (C_b(k))_{4,1})^T) \quad \text{Equation 32}$$

The processing of DOL1(b) may be said to relate to an example of extracting elements from the covariance matrix of the input audio signal in the relevant frequency subband.

DOL1(c): The dominant directions of arrival for band b may be determined by finding all of the local maxima of the projection function:

$$\text{proj}(\vec{v}) = DS(\vec{v}) \times C_b(k) \times DS(\vec{v})^* \quad \text{Equation 33}$$

One example method, which may be used to search for local minima, operates by refining an initial estimate by a gradient-search method, so as to maximise the value of $\text{proj}(\vec{v})$. The initial estimates may be found by:

Selecting a number of random directions as starting points

Taking each of the dominant directions (for this band, b) from the previous time-block, k−1, as starting points Accordingly, determining the set of dominant directions of sound arrival may involve at least one of extracting elements from a covariance matrix of the input audio signal in the relevant frequency subband, and determining local maxima of a projection function of the input audio signal in the frequency subband. The projection function may be based on the covariance matrix (e.g., normalized covariance matrix) of the input audio signal and a spatial panning function of the spatial format, for example.

At step S720, a union of the sets of the one or more dominant directions for the plurality of frequency subbands is determined. This may involve performing process DOL2 described below.

DOL2: From the collection of the dominant sound-arrival directions form the union of the dominant sound-arrival direction sets of all bands:

$$V=U_bV_b \quad \text{Equation 34}$$

The methods (DOL1(a), DOL1(b) and DOL1(c)) outlined above may be used to determine a set of dominant sound arrival directions ($\vec{d}_{b,1}$, $\vec{d}_{b,2}$,) for band b. For each of these dominant sound-arrival-directions, a corresponding "confidence factor" ($w_{b,1}$, $w_{b,2}$,) may be determined, indicating how much weighting should be given to each dominant sound-arrival-direction.

In the most general case, the weighting may be calculated by combining together a number of factors, as follows:

$$w_{b,m}=\text{Weight}_L(\text{pwr}_b(k))\times\text{Steer}(C'_b(k),\vec{d}_{b,m}) \quad \text{Equation 35}$$

In Equation 35, the function $\text{Weight}_L(\ )$ provides a "loudness" weighting factor that is responsive to the power of the input signal in band b at time-block, k. For example, an approximation to the specific loudness of the audio signal in band b may be used:

$$\text{Weight}_L(x)=x^{0.3} \quad \text{Equation 36}$$

Likewise, in Equation 35, the function Steer( ) provides a "directional-steering" weighting factor that is responsive to the degree to which the input signal contains power in the direction $\vec{d}_{b,m}$.

For each band b, the dominant sound arrival directions ($\vec{d}_{b,1}$, $\vec{d}_{b,2}$,) and their associated weights ($w_{b,1}$, $w_{b,2}$,) have been defined (as per the algorithm step DOL1). Next, as per algorithm step DOL2, the directions and weights for all bands are combined together to form a single set of directions and weights (referred to as $\vec{d}'_j$ and $w'_j$, respectively):

$$V = U_b\,V_b \quad \text{Equation 37}$$

$$= \left\{\left(\vec{d}'_1, w'_1\right), \left(\vec{d}'_2, w'_2\right), \ldots\right\} \quad \text{Equation 38}$$

At step S730, a clustering algorithm is applied to the union of the sets to determine the plurality of object locations. This may involve performing process DOL3 described below.

DOL3: Determine the $n_o$ object directions from the weighted set of dominant sound-arrival directions:

$$[\vec{v}_1, \vec{v}_2, \ldots, \vec{v}_{n_o}]=\text{cluster}(V) \quad \text{Equation 39}$$

Algorithm step DOL3 will then determine a number ($n_o$) of object locations. This can be achieved by a clustering algorithm. If the dominant directions have associated weights, the clustering algorithm may perform weighted clustering of the dominant directions. Some alternative methods for DOL3 are, for example:

DOL3(a) The Weighted k-means algorithm, (for example as described by Steinley, Douglas. "K-means clustering: A half-century synthesis." British Journal of Mathematical and Statistical Psychology 59.1 (2006): 1-34), may be used to find a set of $n_o$ centroids, ($\vec{e}_1$, $\vec{e}_2$, $\vec{e}_{n_o}$), by clustering the set of directions into $n_o$ subsets. This set of centroids is then normalized and permuted to create the set of object locations, ($\vec{v}_1(k)$, $\vec{v}_2(k)$, $\vec{v}_{n_o}(k)$), according to:

$$\vec{v}_1(k)=\text{norm}(\vec{e}_{perm(k)}) \quad \text{Equation 40}$$

where the permutation, perm( ), is performed so as to minimise the block-to-block object position change:

$$\text{change}=\Sigma_{o=1}^{n_o}|\vec{v}_o(k)-\vec{v}_o(k-1)|^2 \quad \text{Equation 41}$$

DOL3(b) Other clustering algorithms, such as Expectation-Maximization, may be used DOL3(c) In the special case, when $n_o$=1, the weighted mean of the dominant sound arrival directions may be used:

$$\vec{e}_1 = \frac{\sum_j w'_j\vec{d}'_j}{\sum_j w'_j} \quad \text{Equation 42}$$

and then normalized:

$$\vec{v}_1(k)=\text{norm}(\vec{e}_1) \quad \text{Equation 43}$$

Accordingly, the clustering algorithm in step S730 may be one of a k-means algorithm, a weighted k-means algorithm, an expectation-maximization algorithm, and a weighted mean algorithm, for example.

Figure 6:
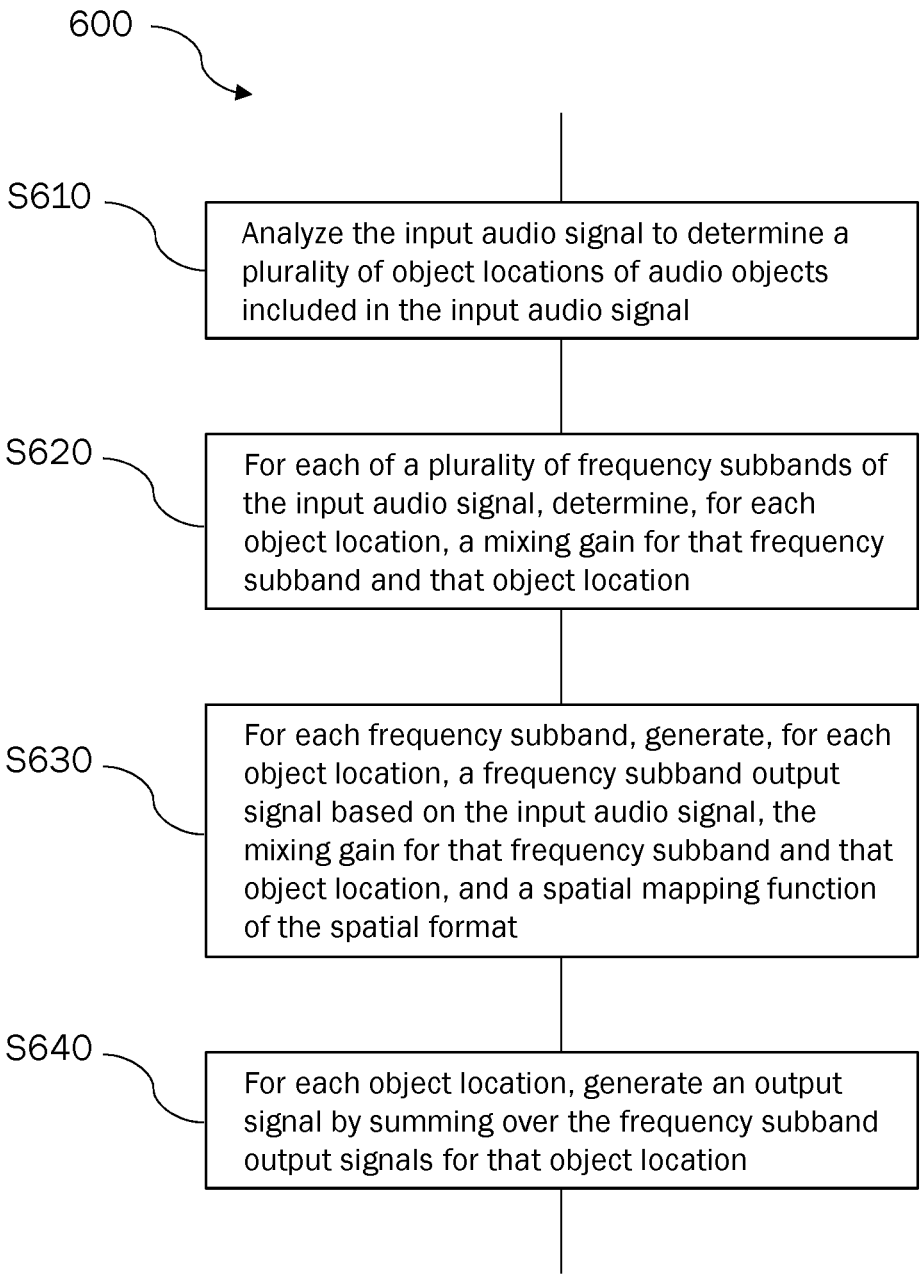
FIG. 6 shows a flow chart of another example of a method for converting a spatial audio format to an object-based audio format.
Figure 8:
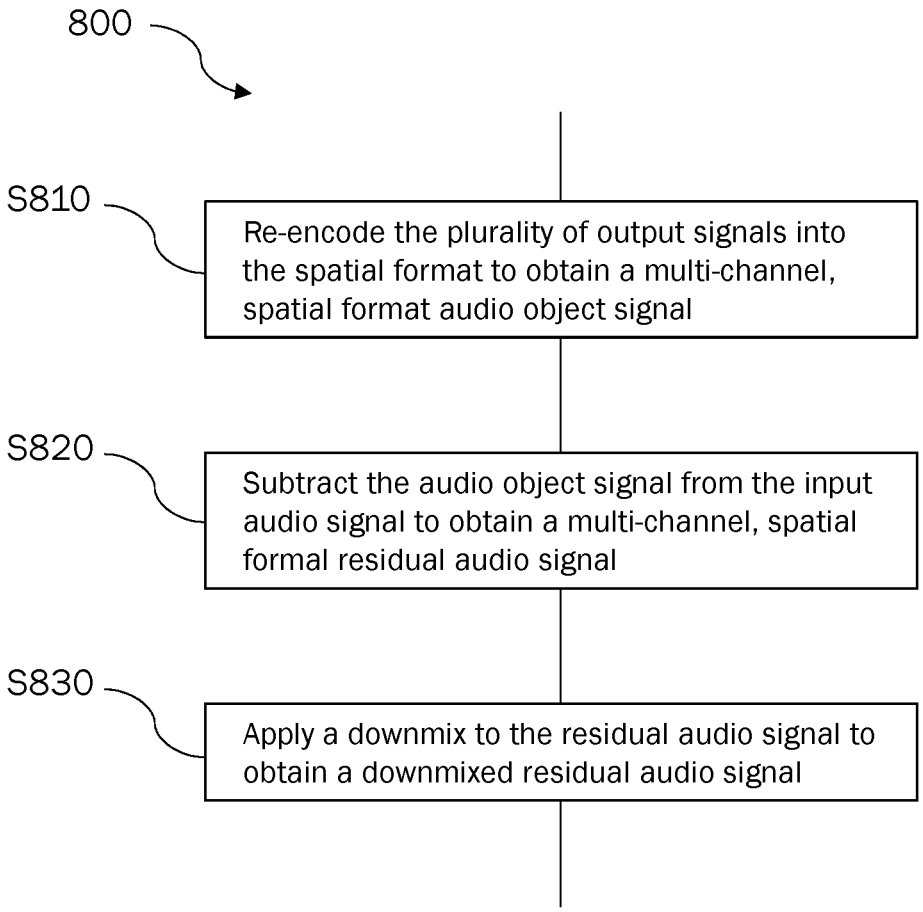
FIG. 8 is a flow chart of an example of a method that may be performed in conjunction with the method of FIG. 6.

FIG. 8 is a flow chart of an example of a method 800 that may optionally be performed in conjunction with the method 600 of FIG. 6, for example after step S640.

At step S810, the plurality of output signals are re-encoded into the spatial format to obtain a multi-channel, spatial format audio object signal.

At step S820, the audio object signal is subtracted from the input audio signal to obtain a multi-channel, spatial formal residual audio signal.

At step S830, a downmix is applied to the residual audio signal to obtain a downmixed residual audio signal. Therein, the number of channels of the downmixed residual audio signal may be smaller than the number of channels of the input audio signal. Step S830 may be optional.

Processing relating to extraction of object audio signals that may be used for implementing steps S620, S630, and S640 will be described next. This processing may be performed by/at blocks 103 of FIG. 1 and 205 of FIG. 2, for example. The DOL process (DOL1 to DOL3 described above) determines the locations, $\vec{v}_o(k)$, of $n_o$ objects ($o\in[1, n_o]$), at each time-block, k. Based on these object locations, the spatial audio input signals are processed (e.g., at blocks 103 or 205) to form a set of $n_o$ object output signals and $n_r$ residual output signals. This process may be referred to by the shorthand name EOS, and in some embodiments, this process is achieved (e.g., at each time-block k) by the steps EOS1 to EOS6:

EOS1: Determine the $[n_o\times n_s]$ object-decoding matrix by stacking $n_o$ row-vectors:

$$D = \begin{pmatrix} DS(\vec{v}_1(k)) \\ DS(\vec{v}_1(k)) \\ \vdots \\ DS(\vec{v}_{n_o}(k)) \end{pmatrix} \quad \text{Equation 44}$$

The object-decoding matrix D is an example of a spatial decoding matrix. In general, the spatial decoding matrix includes a plurality of mapping vectors (e.g., vectors DS($\vec{v}_i(k)$)), one mapping vector for each object location. Each of these mapping vectors may be obtained by evaluating a spatial decoding function at the respective object location.

The spatial decoding function may be a vector-valued function (e.g., a $1\times n_s$ row vector of the multi-channel, spatial format input audio signal is defined as a $n_s\times 1$ column vector) $\mathbb{R}^3\rightarrow\mathbb{R}^{n_s}$.

EOS2: Determine the $[n_s\times n_o]$ object-encoding matrix by stacking $n_o$ column-vectors:

$$E=(PS(\vec{v}_1(k))PS(\vec{v}_2(k))\ldots PS(\vec{v}_{n_o}(k))) \quad \text{Equation 45}$$

The object-encoding matrix E is an example of a spatial panning matrix. In general, the spatial panning matrix includes a plurality of mapping vectors (e.g., vectors $PS(\vec{v}_i(k))$), one mapping vector for each object location. Each of these mapping vectors may be obtained by evaluating a spatial panning function at the respective object location. The spatial panning function may be a vector-valued function (e.g., a $n_s\times 1$ column vector of the multi-channel, spatial format input audio signal is defined as a $n_s\times 1$ column vector) $\mathbb{R}^3\rightarrow\mathbb{R}^{n_s}$.

EOS3: For each band $b\in[1, n_b]$, and for each output object $o\in[1, n_o]$, determine the object gain $g_{b,o}$, where $0\leq g_{b,o}\leq 1$. These object or mixing gains may be frequency-dependent. In some embodiments:

$$g_{b,o}=\text{Steer}(C'_b(k),\vec{v}_o(k)) \quad \text{Equation 46}$$

Arrange these object gain coefficients to form the object gain matrix, $G_b$ (this is an $[n_o\times n_o]$ diagonal matrix):

$$G_b=\begin{pmatrix} g_{b,1} & 0 & \cdots & 0 \\ 0 & g_{b,2} & \cdots & 0 \\ \vdots & \vdots & \ddots & \vdots \\ 0 & 0 & \cdots & g_{b,n_o} \end{pmatrix} \quad \text{Equation 47}$$

The object gain matrix $G_b$ may be referred to as a gain matrix in the following. This gain matrix includes the determined mixing gains for frequency subband b. In more detail, it is a diagonal matrix that has the mixing gains (one for each object location, appropriately ordered) as its diagonal elements.

Thus, process EOS3 determines, for each frequency subband and for each object location, a mixing gain (e.g., frequency dependent mixing gain) for that frequency subband and that object location. As such, process EOS3 is an example of an implementation of step S620 of method 600 described above. In general, determining the mixing gain for a given frequency subband and a given object location may be based on the given object location and the covariance matrix (e.g., normalized covariance matrix) of the input audio signal in the given frequency subband. Dependence on the covariance matrix may be through the steering function $\text{Steer}(C'_b(k), \vec{v}_o(k))$, which is based on (e.g., depends) on the covariance matrix C (or the normalized covariance matrix C') of the input audio signal. That is, the mixing gain for the given frequency subband and the given object location may depend on the steering function for the input audio signal in the given frequency band, evaluated at the given object location.

EOS4 Compute the frequency-domain object output signals, T(k, f), by applying the object decoding matrix and the object gain matrix to the spatial input signals, S(k, f), and by summing over the frequency subbands b:

$$T(k,f)=\begin{pmatrix} T_1(k,f) \\ T_2(k,f) \\ \vdots \\ T_{n_o}(k,f) \end{pmatrix}=\sum_{b=1}^{n_b}\text{band}_b(f)\times G_b\times D\times S(k,f) \quad \text{Equation 48}$$

(refer to Equation No. 3 for the definition of S(k, f)). The frequency-domain object output signals, T(k, f), may be referred to as frequency subband output signals. The sum may be a weighted sum, for example.

Process EOS4 is an example of an implementation of steps S630 and S640 of method 600 described above.

In general, generating the frequency subband output signal for a frequency subband and an object location at step S630 may involve applying a gain matrix (e.g., matrix $G_b$) and a spatial decoding matrix (e.g., matrix D) to the input audio signal. Therein, the gain matrix and the spatial decoding matrix may be successively applied.

EOS5: Compute the frequency-domain residual spatial signals by re-encoding the object output signals, T(k, f), and subtracting this re-encoded signal from the spatial input:

$$S'(k,f)=S(k,f)-E\times T(k,f) \quad \text{Equation 49}$$

Determine the $[n_r\times n_s]$ residual downmix matrix R (for example, via the method of Equation 29), and compute the frequency-domain residual output signals transforming the residual spatial signals via this residual downmix matrix:

$$\begin{pmatrix} U_1(k,f) \\ U_2(k,f) \\ \vdots \\ U_{n_r}(k,f) \end{pmatrix}=R\times S'(k,f) \quad \text{Equation 50}$$

As such, process EOS5 is an example of an implementation of steps S810, S820, and S830 of method 800 described above. Re-encoding the plurality of output signals into the spatial format may thus be based on the spatial panning matrix (e.g., matrix E). For example, re-encoding the plurality of output signals into the spatial format may involve applying the spatial panning matrix (e.g., matrix E) to a vector of the plurality of output signals. Applying a downmix to the residual audio signal (e.g., S') may involve applying a downmix matrix (e.g., downmix matrix R) to the residual audio signal.

The first 2 steps in the EOS process, EOS1 and EOS2, involve the calculation of matrix coefficients, suitable for extracting object-audio signals from the spatial audio input (using the D matrix), and re-encoding these objects back into the spatial audio format (using the E matrix). These matrices are formed by using the PS( ) and DS( ) functions. Examples of these functions (for the case where the input spatial audio format is $2^{nd}$-order Ambisonics) are given in Equations 10 and 11.

The EOS3 step may be implemented in a number of ways. Some alternative methods are:

EOS3(a): The object gains ($g_{b,o}$: $o\in[1, n_o]$) may be computed using the method of Equation 51:

$$g_{b,o}=\text{Steer}(C'_b(k),\vec{v}_o(k)) \quad \text{Equation 51}$$

In this embodiment, the Steer( ) function is used to indicate what proportion of the spatial input signal is present in the direction, $\vec{v}_o(k)$.

Thereby, a mixing gain (e.g., frequency dependent mixing gain) for each frequency subband and for each object location can be determined (e.g., calculated). In general, determining the mixing gain for a given frequency subband and a given object location may be based on the given object location and the covariance matrix (e.g., normalized covariance matrix) of the input audio signal in the given frequency subband. Dependence on the covariance matrix may be through the steering function Steer($C'_b(k)$, $\vec{v}_o(k)$), which is based on (e.g., depends) on the covariance matrix C (or the normalized covariance matrix C') of the input audio signal. That is, the mixing gain for the given frequency subband and the given object location may depend on the steering function for the input audio signal in the given frequency band, evaluated at the given object location.

EOS3(b): In general, determining the mixing gain for the given frequency subband and the given object location may be further based on a change rate of the given object location over time. For example, the mixing gain may be attenuated in dependence on the change rate of the given object location.

In other words, the object gains may be computed by combining a number of gain-factors (each of which is generally a real value in the range [0,1]). For example:

$$g_{b,o}=g_{b,o}^{(Steer)}\times g_{b,o}^{(jump)} \quad \text{Equation 52}$$

where $$g_{b,o}^{(Steer)}=\text{Steer}(C'_b(k),\vec{v}_o(k)) \quad \text{Equation 53}$$

and $g_{b,o}^{(jump)}$ is computed to be a gain factor that is approximately equal to 1 whenever the object location is static ( $\vec{v}_o(k-1)\approx\vec{v}_o(k)\approx\vec{v}_o(k+1)$) and approximately equal to 0 when the object location is "jumping" significantly in the region around time-block k (for example, when $|\vec{v}_o(k-1)-\vec{v}_o(k)|^2>\alpha$ or $|\vec{v}_o(k+1)-\vec{v}_o(k)|^2>\alpha$, for some threshold $\alpha$)

The gain-factor $g_{b,o}^{(Jump)}$ is intended to attenuate the object amplitude whenever an object location is changing rapidly, as may occur when a new object "appears" at time-block k in a location where no object existed during time-block k−1.

In some embodiments $g_{b,o}^{(Jump)}$ is computed by first computing the jump value:

$$\text{jump}=\max(|\vec{v}_o(k-1)-\vec{v}_o(k)|^2,|\vec{v}_o(k+1)-\vec{v}_o(k)|^2) \quad \text{Equation 54}$$

and then computing $g_{b,o}^{(Jump)}$:

$$g_{b,o}^{(Jump)}=\max\left(0,1-\frac{\text{jump}}{\alpha}\right) \quad \text{Equation 55}$$

In some embodiments, a suitable value for $\alpha$ is 0.5, an in general will choose $\alpha$ such that $0.05<\alpha<1$.

Figure 5:
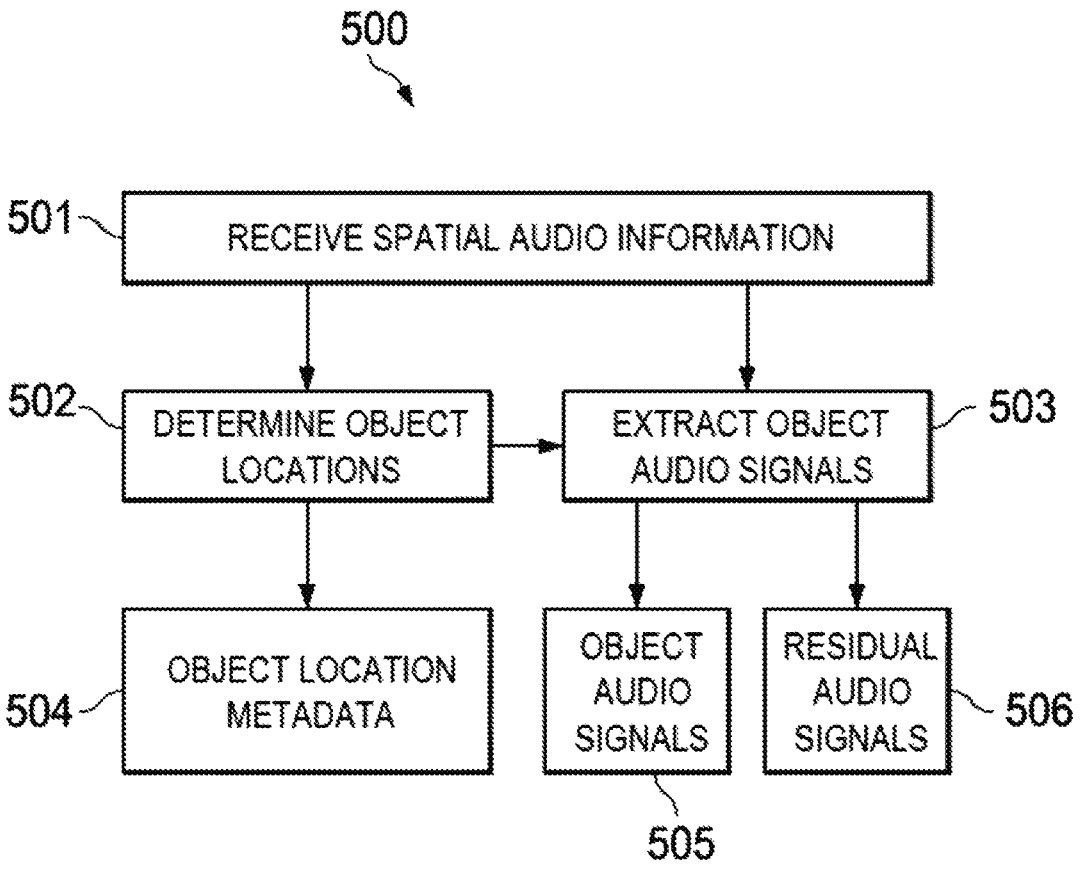
FIG. 5 shows a flow chart of an exemplary method for converting a spatial audio format (for example, Ambisonics, HOA, or B-format) to an object-based audio format (for example, Dolby's Atmos format).

FIG. 5 illustrates an exemplary method 500 in accordance with present principles. Method 500 includes, at 501, receiving spatial audio information. The spatial audio information may be consistent with $n_s$-channel Spatial Audio Format 101 shown in FIG. 1 and an $s_i(t)$ (input signal for channel i) 201 shown in FIG. 2. At 502, object locations may be determined based on the received spatial audio information. For example, the object locations may be determined as described in connection with blocks 102 shown in FIG. 1 and 204 shown in FIG. 2. Block 502 may output object location metadata 504. The object location metadata 504 may be similar to the object location metadata 111 shown in FIG. 1 and $\vec{v}_o(k)$ (location of object o) 211 shown in FIG. 2.

At 503, object audio signals may be extracted based on the received spatial audio information. For example, the object audio signals may be extracted as described in connection with blocks 103 shown in FIG. 1 and 205 shown in FIG. 2. Block 503 may output object audio signals 505. The object audio signals 505 may be similar to the object audio signals 112 shown in FIG. 1 and output signal for object o 213 shown in FIG. 2. Block 503 may further output residual audio signals 506. The residual audio signals 506 may be similar to the residual audio signals 113 shown in FIG. 1 and output residual channel r 215 shown in FIG. 2.

Methods of processing multi-channel, spatial format input audio signals have been described above. It is understood that the present disclosure likewise relates to apparatus for processing multi-channel, spatial format input audio signals. The apparatus may comprise a processor adapted to perform any of the processes described above, e.g., the steps of methods 600, 700, and 800, as well as their respective implementations DOL1 to DOL3 and EOS1 to EOS5. Such apparatus may further comprise a memory coupled to the processor, the memory storing respective instructions for execution by the processor.

Various modifications to the implementations described in this disclosure may be readily apparent to those having ordinary skill in the art. The general principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

The methods and systems described in the present document may be implemented as software, firmware and/or hardware. Certain components may e.g. be implemented as software running on a digital signal processor or microprocessor. Other components may e.g. be implemented as hardware and or as application specific integrated circuits. The signals encountered in the described methods and systems may be stored on media such as random access memory or optical storage media. They may be transferred via networks, such as radio networks, satellite networks, wireless networks or wireline networks, e.g. the Internet. Typical devices making use of the methods and systems described in the present document are portable electronic devices or other consumer equipment which are used to store and/or render audio signals.

Further implementation examples of the present invention are summarized in the enumerated example embodiments (EEEs) that are listed below.

A first EEE relates to a method for processing a multi-channel, spatial audio fauna input signal. The method comprises determining object location metadata based on the received spatial audio format input signal, and extracting object audio signals based on the received spatial audio format input signal. The extracting object audio signals based on the received spatial audio format input signal includes determining object audio signals and residual audio signals.

A second EEE relates to a method according to the first EEE, wherein each extracted audio object signal has a corresponding object location metadata.

A third EEE relates to a method according to the first or second EEEs, wherein the object location metadata is indicative of the direction-of-arrival of an object.

A fourth EEE relates to a method according to any one of the first to third EEEs, wherein the object location metadata is derived from statistics of the received spatial audio format input signal.

A fifth EEE relates to a method according to any one of the first o fourth EEEs, wherein the object location metadata is changing from time to time.

A sixth EEE relates to a method according to any one of the first to fifth EEEs, wherein the object audio signals are determined based on a linear mixing matrix in each of a number of sub-bands of the received spatial audio format input signal.

A seventh EEE relates to a method according to any one of the first to sixth EEEs, wherein the residual signal is a multi-channel residual signal.

An eighth EEE relates to a method according to the seventh EEE, wherein the multi-channel residual signal is composed of a number of channels that is less than a number of channels of the received spatial audio format input signal.

A ninth EEE relates to a method according to any one of the first to eighth EEEs, wherein extracting object audio signals is determined by subtracting the contribution of the said object audio signals from the said spatial audio format input signal A tenth EEE relates to a method according to any one of the first to ninth EEEs, wherein extracting object audio signals includes determining a linear mixing matrix coefficients that may be used by subsequent processing to create the one or more object audio signals and the residual signal.

An eleventh EEE relates to a method according to any one of the first to tenth EEEs, wherein the matrix coefficients are different for each frequency band.

A twelfth EEE relates to an apparatus for processing a multi-channel, spatial audio format input signal. The apparatus comprises a processor for determining object location metadata based on the received spatial audio format input signal, and an extractor for extracting object audio signals based on the received spatial audio format input signal. The extracting object audio signals based on the received spatial audio format input signal includes determining object audio signals and residual audio signals.

The invention claimed is:

1. A method for processing a spatial format input audio signal, wherein the spatial format is one of Higher Order Ambisonics or B-format ambisonics and the spatial format input audio signal comprises a plurality of channels, the method comprising:

determining object locations based on the spatial format input audio signal, wherein the object locations are determined, for a number of frequency subbands, based on one or more dominant sound-arrival-directions; and extracting object audio signals from the spatial format input audio signal based on the object locations, wherein the object audio signals are extracted based on:

for each of the number of frequency subbands of the spatial format input audio signal and for each corresponding object location, a mixing gain is determined for each corresponding frequency subband and corresponding object location;

for each of the number of frequency subbands, for each object location, a frequency subband output signal is determined based on the spatial format input audio signal, the mixing gain for the corresponding frequency subband and the corresponding object location, and a spatial mapping function of the spatial format, wherein the spatial mapping function is a spatial decoding function of the spatial format for extracting an audio signal at a given location, from the plurality of the channels of the spatial format, wherein the mixing gain, for the corresponding frequency subband and the corresponding object location is based on a steering function for the spatial format input audio signal for the corresponding frequency subband, wherein the steering function is based on a covariance matrix of the plurality of channels of the spatial format input audio signal for the corresponding frequency subband, wherein the mixing gain for the corresponding frequency subband and the corresponding object location is further based on a change rate of the corresponding object location over time, wherein the mixing gain is attenuated based on the change rate, and wherein, for each of the corresponding object locations, an output signal is determined based on a sum over the frequency subband output signals for the corresponding object location.

2. The method according to claim 1, wherein the mixing gain is frequency-dependent.

3. The method according to claim 1, wherein a spatial panning function of the spatial format is a function for mapping a source signal at a source location to the plurality of channels defined by the spatial format; and the spatial decoding function is defined such that successive application of the spatial panning function and the spatial decoding function yields unity gain for all locations on the unit sphere.

4. The method according to claim 1, wherein the frequency subband output signal is determined based on an application of a gain matrix and a spatial decoding matrix to the spatial format input audio signal, wherein the gain matrix includes the mixing gain for the corresponding frequency subband, and wherein the spatial decoding matrix includes a plurality of mapping vectors, one for each object location, wherein each mapping vector is obtained by evaluating the spatial decoding function at a respective object location.

5. The method according to claim 1, further comprising:

re-encoding the plurality of output signals into the spatial format to obtain a multi-channel, spatial format audio object signal; and subtracting the audio object signal from the spatial format input audio signal to obtain the multi-channel, spatial format residual audio signal.

6. The method according to claim 5, further comprising:

applying a downmix to the residual audio signal to obtain a downmixed residual audio signal, wherein the number of channels of the downmixed residual audio signal is smaller than the number of channels of the spatial format input audio signal.

7. The method according to claim 1, wherein the corresponding objection location is based on a union of sets of dominant sound-arrival-directions for the number of frequency subbands, and a clustering algorithm applied to the union to determine the corresponding object location.

8. The method according to claim 7, wherein determining the set of dominant directions of sound-arrival involves at least one of:

extracting elements from a covariance matrix of the spatial format input audio signal in the frequency subband; and determining local maxima of a projection function of the audio input signal in the frequency subband, wherein the projection function is based on the covariance matrix of the audio input signal and a spatial panning function of the spatial format.

9. The method according to claim 7, wherein each dominant direction has an associated weight; and the clustering algorithm performs weighted clustering of the dominant directions.

10. The method according to claim 7, wherein the clustering algorithm is one of:

a k-means algorithm, a weighted k-means algorithm, an expectation-maximization algorithm, and a weighted mean algorithm.

11. The method according to claim 1, further comprising:

generating object location metadata indicative of the object locations.

12. The method of claim 1, wherein the object audio signals are determined based on a linear mixing matrix in each of the number of sub-bands of the received spatial format input signal.

13. The method of claim 12, wherein the matrix coefficients are different for each frequency band.

14. The method of claim 1, wherein extracting object audio signals is determined by subtracting the contribution of said object audio signals from the spatial formats input audio signal.

15. An apparatus for processing a spatial format input audio signal, wherein the spatial format is one of Higher Order Ambisonics or B-format ambisonics and the spatial format input audio signal comprises channels, the apparatus comprising:

a processor for determining object locations based on the spatial format input audio signal, wherein the object locations are determined, for a number of frequency subbands, based on one or more dominant sound-arrival-directions; and an extractor for extracting object audio signals from the spatial format input audio signal based on the object locations, wherein the object audio signals are extracted based on:

for each of the number of frequency subbands of the spatial format input audio signal and for each corresponding object location, a mixing gain is determined for each corresponding frequency subband and corresponding object location;

for each of the number of frequency subbands, for each object location, a frequency subband output signal is determined based on the spatial format input audio signal, the mixing gain for the corresponding frequency subband and the corresponding object location, and a spatial mapping function of the spatial format, wherein the spatial mapping function is a spatial decoding function of the spatial format for extracting an audio signal at a given location, from the plurality of the channels of the spatial format, wherein the mixing gain, for the corresponding frequency subband and the corresponding object location is based on a steering function for the spatial format input audio signal for the corresponding frequency subband, wherein the steering function is based on a covariance matrix of the plurality of channels of the spatial format input audio signal for the corresponding frequency subband, wherein the mixing gain for the corresponding frequency subband and the corresponding object location is further based on a change rate of the corresponding object location over time, wherein the mixing gain is attenuated based on the change rate, and wherein, for each of the corresponding object locations, an output signal is determined based on a sum over the frequency subband output signals for the corresponding object location.

16. The apparatus according to claim 15, wherein the mixing gains for the object locations are frequency-dependent.

17. The apparatus according to claim 15, wherein a spatial panning function of the spatial format is a function for mapping a source signal at a source location to the plurality of channels defined by the spatial format; and the spatial decoding function is defined such that successive application of the spatial panning function and the spatial decoding function yields unity gain for all locations on the unit sphere.

18. The apparatus according to claim 15, wherein generating, for each frequency subband and for each object location, the frequency subband output signal involves:

applying a gain matrix and a spatial decoding matrix to the input audio signal, wherein the gain matrix includes the determined mixing gains for that frequency subband; and the spatial decoding matrix includes a plurality of mapping vectors, one for each object location, wherein each mapping vector is obtained by evaluating the spatial decoding function at a respective object location.

* * * * *